US005243768A

United States Patent [19]

Fukao et al.

[11] Patent Number: 5,243,768

[45] Date of Patent: Sep. 14, 1993

[54] VAPOR DRIER

[75] Inventors: Takahisa Fukao; Masaaki Mita, both of Kitakyushu; Seiji Sudoh, Sendai; Katashi Shioda, Hadano, all of Japan

[73] Assignee: Mitsubishi Kasei Corporation, Tokyo, Japan

[21] Appl. No.: 835,582

[22] Filed: Feb. 14, 1992

[30] Foreign Application Priority Data

Feb. 18, 1991 [JP] Japan ..... 2-23524
Feb. 18, 1991 [JP] Japan ..... 2-23525

[51] Int. Cl.[5] ..... F26B 3/00
[52] U.S. Cl. ..... 34/22; 34/82
[58] Field of Search ..... 34/12, 73, 32, 26, 22, 34/82, 72; 134/11

[56] References Cited

U.S. PATENT DOCUMENTS 5,105,556 4/1992 Kurokawa et al. ..... 34/12

FOREIGN PATENT DOCUMENTS 61-239628 10/1986 Japan .
62-45127 2/1987 Japan .
4-171025 6/1992 Japan .
4-171026 6/1992 Japan .
92/07647 5/1992 World Int. Prop. O. .

OTHER PUBLICATIONS

Electronic Parts and Materials, Mar. 1983, Kogyo Chosakai Publishing Co., Ltd., pp. 68–71.

*Primary Examiner*—Henry A. Bennet
*Attorney, Agent, or Firm*—Oblon, Spivak, McClelland, Maier & Neustadt

[57] ABSTRACT

A hydrophilic drying liquid such as isopropyl alcohol is evaporated and supplied to an object to be dried such as an electronic component. As the drying liquid is condensed on the surface of the object and flows down together with water adhering to the object, the object is dried. Water contained in the condensate is removed by means of a membrane-type separator disposed in the liquid or vapor of the drying liquid. A rise in the water concentration in the drying liquid is prevented so as to maintain high drying efficiency.

20 Claims, 6 Drawing Sheets

VAPOR DRIER

BACKGROUND OF THE INVENTION

1. Field of the Invention

The present invention relates to a vapor drier used to dry precision component parts in electronic, optical and other fields, and more particularly to a vapor drier in which a vapor drying liquid can be regenerated and reused and in which the amount of water contained in the vapor drying liquid can be controlled to a fixed level or below.

2. Description of the Related Art

As a method of drying an object to be dried after washing, a so-called vapor drying method is known. This drying method is carried out by using a drying liquid consisting essentially of an organic solvent which is very hydrophilic and which has a low boiling point, such as isopropyl alcohol (hereafter also referred to as IPA).

Specifically, this drying method can be implemented by using an apparatus whose basic construction is such that a cooling section is provided in its upper portion, and a vapor generating tank which can be heated is disposed in its lower portion. If an object to be dried is placed in an open space above the vapor generating tank, IPA vapor evaporating from the heated vapor generating tank is condensed on the surface of the object to be dried. Since the condensed IPA flows down together with the water adhering to the object to be dried, the drying of the object to be dried is accomplished.

If IPA condensed on the surface of the object to be dried is allowed to drop into a drying liquid tank, the concentration of water in IPA soon becomes high, and the concentration of water in the evaporating IPA vapor also becomes high. Consequently, the drying efficiency declines.

Accordingly, it is conceivable to adopt a structure in which all the IPA condensed on the surface of the object to be dried is discarded to prevent the condensed IPA from entering the vapor generating tank. If this structure is adopted, it is possible to prevent water from being directly mixed with IPA in the tank.

In the apparatus, however, the IPA vapor which did not condense on the surface of the object to be dried is refluxed in the cooling section located in an upper portion of the apparatus, is returned to the drying liquid tank, is heated again, and is evaporated on a repeated basis.

Meanwhile, even if the above-described structure, in which IPA condensed on the surface of the object to be dried is prevented from directly entering the vapor generating tank, is adopted, water is directly evaporated, although in small amounts, from water droplets attached to the object to be dried. The water vapor is refluxed together with the IPA vapor.

Accordingly, as dry processing is repeated, the concentration of water in the drying liquid in the tank increases, so that the above-described problem occurs.

It is known that the above-described problem is particularly important in cases where the objects to be dried are semiconductor wafers.

It should be noted that a description of driers is given on pages 68–71 of the March 1983 issue of *electronic Parts and Materials* published by Kogyo Chosakai Publishing Co., Ltd.

In addition, a technique whereby the concentration of water vapor in the drying liquid vapor in the vapor drier can be automatically controlled to a low level is disclosed in Japanese Patent Application Laid-Open No. 45127/1987.

In this technique, in a vapor drier having discarding means for discarding a drying liquid in a vapor generating tank and supplying means for supplying new drying liquid, when the concentration of water in the drying liquid in the vapor generating tank reaches a predetermined value, all or part of the drying liquid in the tank is discarded. New drying liquid is replenished, thereby making it possible to control the concentration of water in the drying liquid in the vapor generating tank to a predetermined level or below. At the same time, the content of water vapor in the drying liquid vapor evaporating from the vapor generating tank is controlled to a predetermined level or below.

By virtue of this technique, the concentration of water in the drying liquid can be controlled, but the continual replenishment of the new IPA according to the above-described method results in a rise in cost. The problem of disposing of the used IPA also arises.

Therefore, in order to obtain a distillate whose water concentration is held down to not more than a level which does not present a problem in the drying of precision electronic and optical components by using a known distillation method, a distillation device becomes complex and large in scale. In the case of IPA, for instance, since an IPA concentration in the vicinity of 88 wt.% exhibits an azeotropic composition with respect to water, it is impossible to obtain an IPA having a higher concentration than the aforementioned level by means of a normal distilling operation. In this case, as a generally used concentrating method, a method is known in which azeotropic distillation is effected by adding a benzene entrainer. This method requires at least three towers, i.e., a dehydrating tower using the entrainer, a tower for removing water collected by the entrainer, and an IPA refining tower. In order to obtain a distillate in which the water content is held down to not more than a level which does not present a problem in the drying of precision electronic and optical components, a distilling tower normally becomes 6 m or higher, and hence occupies a large space in a clean room of a plant for manufacturing precision electronic or optical components. If such a complicated distilling operation is conducted, the cost of equipment becomes high, and the adoption of this method is quite difficult in terms of space. In addition, it has been difficult to carry out the regeneration of IPA in terms of energy cost as well.

In contrast, a technique which employs a membrane separation operation instead to the distilling operation in a dehydration process is disclosed in Japanese Patent Application Laid-Open No. 239628/1986. The following steps are adopted in this apparatus: cleaning semiconductors by means of the vapor of an organic solvent; processing and dehydrating waste liquid of the organic solvent by a pervaporation method; distilling the dehydrated organic solvent; and circulating the organic solvent. In this case, since most of the dehydrating operation is effected by the membrane separation operation, a distilling device can be made compact, but a space equivalent to or larger than that of a vapor drier body is still required for the dehydrating step. In addition, since a membrane type separator and the distilling device are operated separately, this technique has been disadvantageous in terms of the energy cost.

Particularly in recent years, in conjunction with the trend toward greater integration and higher precision of semiconductors and liquid crystals, there has been a demand for maintaining the concentration of water in the vapor drying liquid at a low level and for processing a large amount of drying liquid in a small space so as to improve productivity. For instance, in order to effect dry processing of fifty 6-inch wafers/batch for 16 M DRAMs, it is required to set the water concentration in IPA to 0.5% (5000 ppm) or less and the rate of processing with IPA to 10 kg/hr.

SUMMARY OF THE INVENTION

Accordingly, it is a primary object of the present invention to provide a vapor drier capable of maintaining a high drying efficiency by setting the water content of a drying liquid to a low level, thereby overcoming the above-described drawbacks of the conventional art.

The present inventors have realized the above-described object by disposing a membrane-type separator having a high permeation rate, a high separation ratio, and high heat resistance in a drying liquid in a vapor generating section.

That is, in accordance with the present invention, there is provided a vapor drier for drying an object to be dried after washing, comprising: a vapor generating section for generating the vapor of a drying liquid by heating the drying liquid; a vapor drying section for drying the object to be dried by means of the vapor generated; and a membrane-type separator disposed in the drying liquid in the vapor generating section or in a space filled with vapor above the drying liquid level inside the vapor generating section. The membrane-type separator is constituted by separating membranes which selectively allow water to permeate the separating membranes.

A detailed description will be given hereafter of the present invention.

The vapor drier in accordance with the present invention mainly comprises the vapor generating section, the vapor drying section, and the membrane-type separator disposed below the drying liquid level or in a space filled with vapor inside the vapor generating section.

As the drying liquid used, an organic solvent having a high hydrophilic property and displaying azeotropy with respect to water is suitable. As examples of such an organic solvent, it is possible to cite lower alcohols having a carbon number of 1 to 5, such as isopropyl alcohol (IPA), ethanol, n-propanol, isobutanol, and isoamyl alcohol. In addition, it is also possible to use chlorinated hydrocarbons such as methyl chloride, methylene chloride, and carbon tetrachloride. Of these, IPA is particularly suitable. Although a description will be given hereafter by citing IPA as an example of the drying liquid, the present invention is not limited to IPA.

In the present invention, the membrane-type separator, which is constituted by membranes which selectively allow water to permeate the membranes in the IPA liquid or IPA vapor in the vapor generating section, is disposed. As a result, IPA whose water concentration has become high can be regenerated and reused, and the concentration of water in IPA can be controlled.

In a vapor membrane-type separator, a major portion of water contained in IPA is normally removed by a pervaporation method or a vapor permeation method.

As the membrane-type separator, any known device can be used without restrictions as long as it uses membranes capable of selectively allowing water in an IPA-water system to permeate the membranes. As the separating membranes, those exhibiting a water permeation coefficient of 0.1 $kg/m^2 \cdot hr$ or more, preferably 1 $kg/m^2 \cdot hr$ or more, a separation coefficient of 100 or more, preferably 1000 or more, and a thermal deformation temperature of 150° C. or more (JIS K7207: Testing Method for Deflection Temperature of Rigid Plastics under Load) may be used.

It should be noted that the separation coefficient is expressed by $$\frac{\text{weight percent of water in permeating vapor/ weight percent of } IPA \text{ in permeating vapor}}{\text{weight percent of primary-side water/ weight percent of primary-side } IPA} \quad (1)$$

As for operating conditions of the membrane-type separator, it is preferred that the temperature of IPA (liquid or vapor thereof for the membrane-type separator) which is present in the vapor generating section be set to 60°–120° C., and the degree of vacuum of the permeation vapor chamber of the membrane type separator be set to 0–100 Torr. Specifically, a temperature in the vicinity of the boiling point of IPA (82.7° C. or thereabouts at 1 atm) is more preferable.

Thus, water is removed from IPA by means of the membrane-type separator, and a small amount of IPA moves to the permeation vapor chamber in correspondence with the value of the separation coefficient and constitutes an IPA loss. However, in a case where dehydration processing is effected from IPA containing 10% water to IPA containing 500 ppm of water by using the membrane-type separator having the aforementioned permeation coefficient and separation coefficient, the loss of the drying liquid is generally 5% or less. The operation is extremely economical as compared with a case where the entire amount of liquid is replaced periodically with new liquid.

It suffices if the amount of water removed by the vapor membrane-type separator is a major portion of water contained in IPA. However, in a case where the vapor drier is used in a precision cleaning process for semiconductor wafers or the like, it is desirable in the light of product quality that water be removed in such a manner that the water content with respect to IPA is reduced to 1% or less, preferably 500 ppm or less, more preferably between not less than 1 ppm and not more than 500 ppm.

The membrane-type separator can be located in either of two places: in the IPA liquid or in the IPA vapor. It is more advantageous to dispose the membrane-type separator in the liquid in the light of separation efficiency and energy cost.

The above and other objects, features and advantages of the invention will become more apparent from the following detailed description of the invention when read in conjunction with the accompanying drawings.

DESCRIPTION OF THE PREFERRED EMBODIMENTS

Referring now to the accompanying drawings, a description will be given of the embodiments of the present invention.

Figure 1:
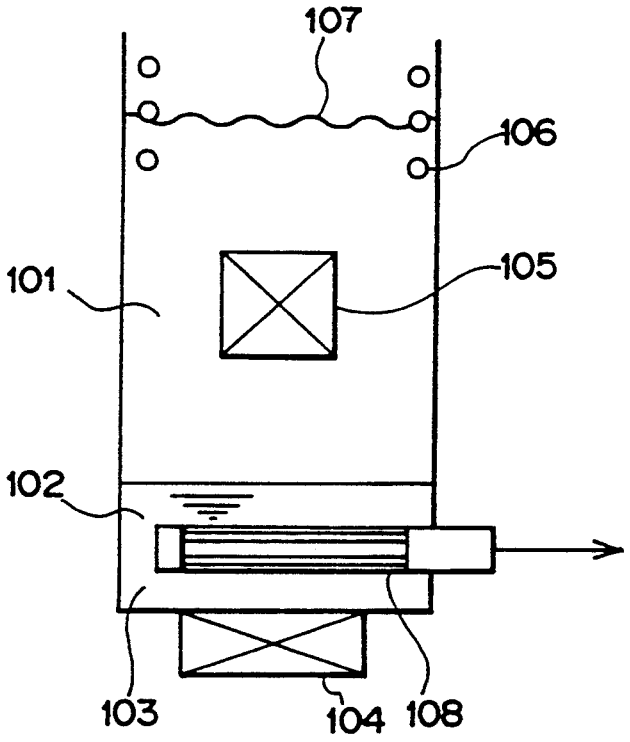
FIG. 1 is a vertical cross-sectional view illustrating a first embodiment of a vapor drier in accordance with the present invention.

FIG. 1 is a schematic diagram illustrating an example of a vapor drier in accordance with the present invention.

Figure 2:
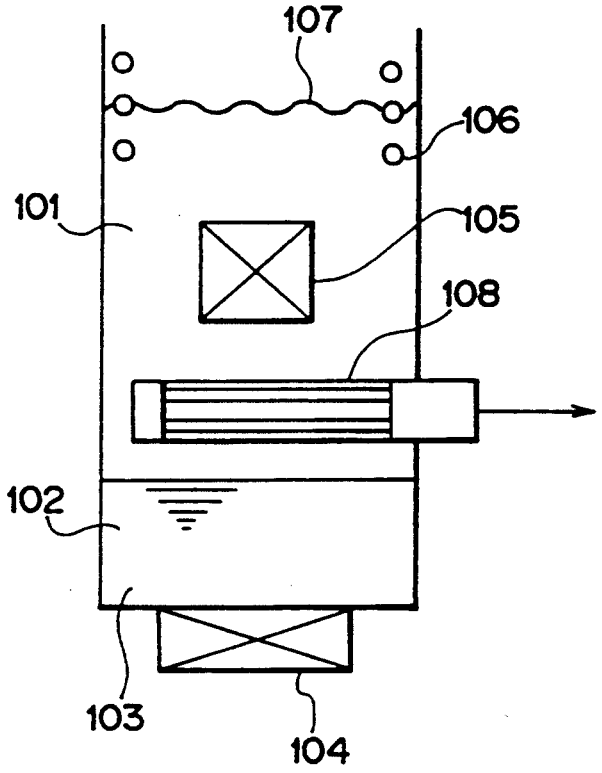
FIG. 2 is a vertical cross-sectional view illustrating a second embodiment of the vapor drier in accordance with the present invention.

The vapor drier comprises a vapor drying section 101 and a vapor generating section 102. IPA 103, which is a drying liquid, is stored in the vapor generating section 102. A heater block 104 for heating and evaporating the IPA is disposed on the underside of a bottom of the vapor generating section 102. An object to be dried 105 is held in the vapor drying section 101, and a cooling pipe 106 is disposed above the object to be dried 105. A membrane type separator 108 is disposed in the IPA in the vapor generating section 102. FIG. 2 is a schematic diagram illustrating an arrangement in which the membrane type separator 108 is disposed in the vapor.

In the present invention, a pump or an agitator for circulating the IPA 103 in the vapor generating section 102 is disposed, as required, to improve the dehydrating performance.

A more detailed description will be given of the membrane-type separator 108.

As the membrane-type separator, one which is basically provided with two chambers, a processing liquid chamber and a permeation vapor chamber, which are partitioned off by hollow-yarn separating membranes, may be generally used. In addition, a membrane type separator of a hollow-yarn module type, in which hollow-yarn separating membranes are bundled together, is suitable as the membrane type separator 108. In addition, a plurality of hollow-yarn membrane modules may be used to the extent that the layout allows.

As the hollow yarn membrane module, two types are known. In one type, both ends of a multiplicity of hollow-yarn membranes are made open, and the hollow-yarn membranes are bonded together and secured by a resin (both-ends open module). In another type of hollow-yarn membrane module, the one ends are sealed and the other ends are made open, and the hollow-yarn membranes are bonded together and secured by a resin (one-end sealed module). In these modules, at least the one ends of the multiplicity of hollow-yarn membranes are bundled together, and the bundled ends are secured by an adhesive in order to prevent the bundle from disintegrating into pieces.

As this adhesive, a bisphenol type, a novolak type, and various other types of epoxy resins, which are thermosetting resins, may preferably be used. In addition, it is also possible to use polyester resins, phenol resins, melamine resins, or the like.

As for the configuration of the hollow-yarn membrane module, a conventionally known configuration may be used, but a hollow-yarn membrane module in which a cavity for supplying or drawing out IPA is provided in a radially central portion of the hollow-yarn bundle is preferable so as to increase the separating efficiency. A description will now be given of this preferred hollow-yarn membrane module with reference to FIG. 3.

Figure 3A:
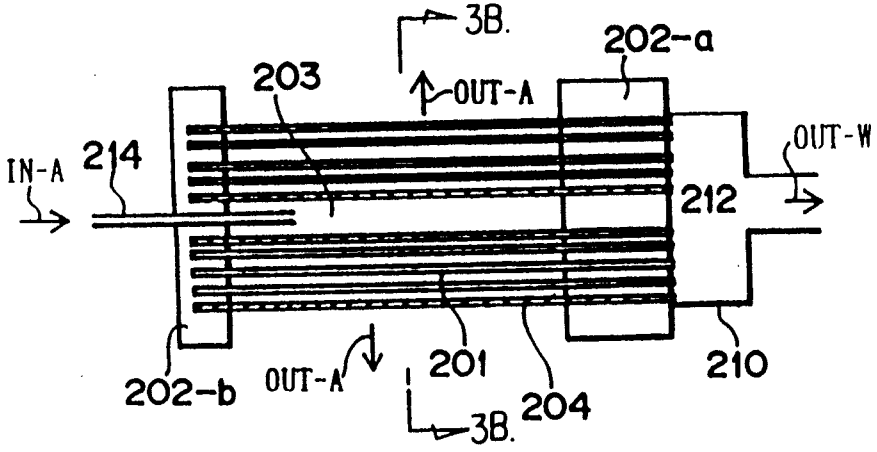
FIG. 3A is a cross-sectional view of a hollow-yarn membrane module used in the present invention.

The hollow-yarn membrane module shown in FIG. 3 uses a multiplicity of hollow-yarn membranes 201. These yarn membranes 201 have a diameter of 0.5–2 mm. A substance to be separated is separated between the inside and the outside of each yarn.

As for these yarn membranes 201, 50 to 50,000 pieces are generally bundled together, and opposite ends thereof are bonded and secured to potting materials **202*a*, 202*b*, respectively. The one ends of the yarn membranes 201 penetrate the potting material 202*a* and communicate with a discharged-side chamber 212 formed between the potting material 202*a* and a cover 210. Meanwhile, the other ends of the yarn membranes 201 are closed off by the potting material 202*b***.

Figure 3B:
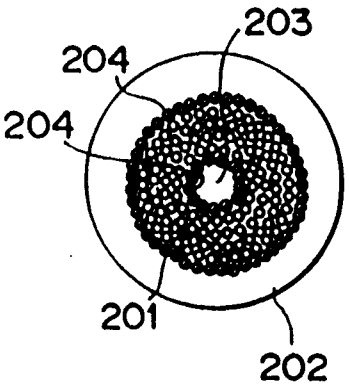
FIG. 3B is a cross-sectional view taken along line B—B of FIG. 3A.

The multiplicity of yarn membranes 201 are formed into a cylindrical configuration as a whole, as shown in FIG. 3B. A radially central portion thereof is formed as a cavity portion 203 and communicates with an IPA introducing pipe 214 penetrating the potting material **202*b***.

If the diameter of the cavity portion 203 is large, the number of the surrounding hollow-yarn membranes inevitably becomes small, which causes a membrane area per module to decline, resulting in a drop in the performance of the membranes. Hence, the diameter of the cavity portion 203 is normally set to not more than $\frac{1}{3}$ of the outside diameter of the hollow-yarn bundle, preferably not more than 1/5 thereof.

In view of the fact that the hollow-yarn filling rate = cross-sectional area of a hollow yarn × number of hollow yarns / cross-sectional area of a module, excluding the cavity portion 203, the arrangement density of the hollow yarns is preferably not less than 0.5, more preferably not less than 0.75, for securing a sufficient membrane area per module. In the preceding formula, the cross-sectional area of a hollow yarn refers to the area calculated by using a radius extending from the center of the cavity portion 203 to the outer periphery of the hollow yarn.

As for the hollow-yarn bundle, it is desirable to provide supports on the inner surface of the cavity portion and on the outer peripheral surface of the hollow-yarn bundle for protecting the hollow-yarn membranes 201. Net-like cylinders may be used as the supports, but it is desirable to use supports having a configuration of a reed screen and constituted by solid yarns 204 which are formed of the same material as the hollow yarns, so that their configuration and forming method need little additional consideration. Since these solid yarns 204 are formed of the same material as that of the hollow yarns, there is an advantage in that the solid yarns 204 can be bonded to the potting portions at the same time as the hollow yarns.

As a result, IPA (indicated by arrow IN-A) which has entered the cavity portion 203 through the introducing pipe 214 is discharged radially through the outer periphery of each yarn membrane 201 (as indicated by arrows OUT-A). Here, the water contained in IPA enters the inner side of each yarn membrane 201, is separated from IPA, and is discharged through the discharge side chamber 212 (as indicated by arrow OUT-W).

Figure 4:
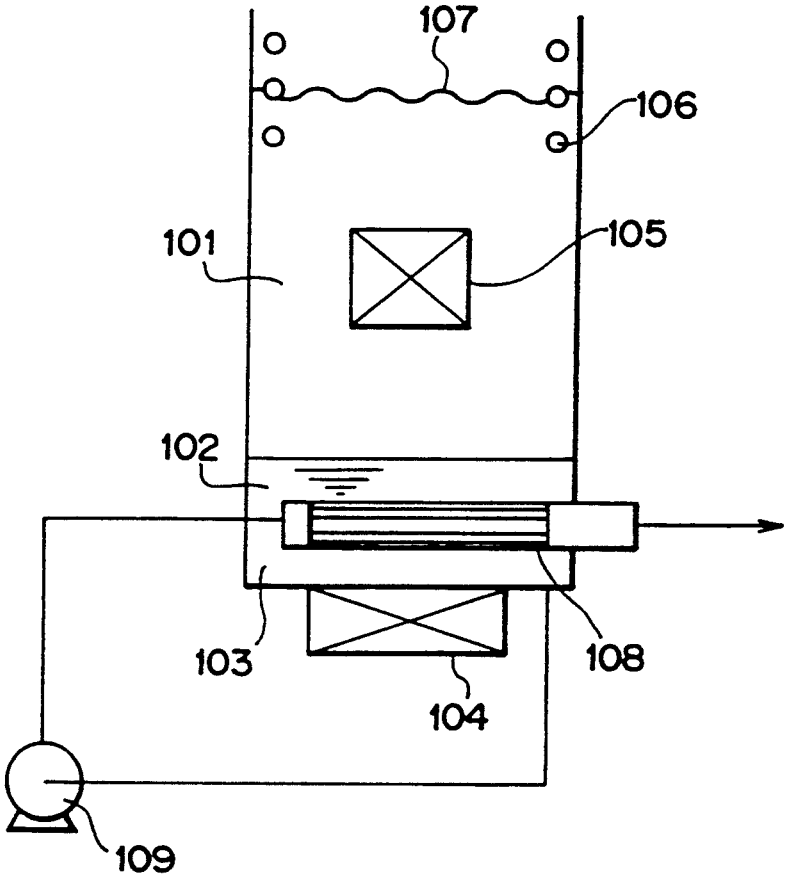
FIG. 4 is a vertical cross-sectional view of a third embodiment illustrating a state in which a circulating passage is provided in FIG. 1.
Figure 5:
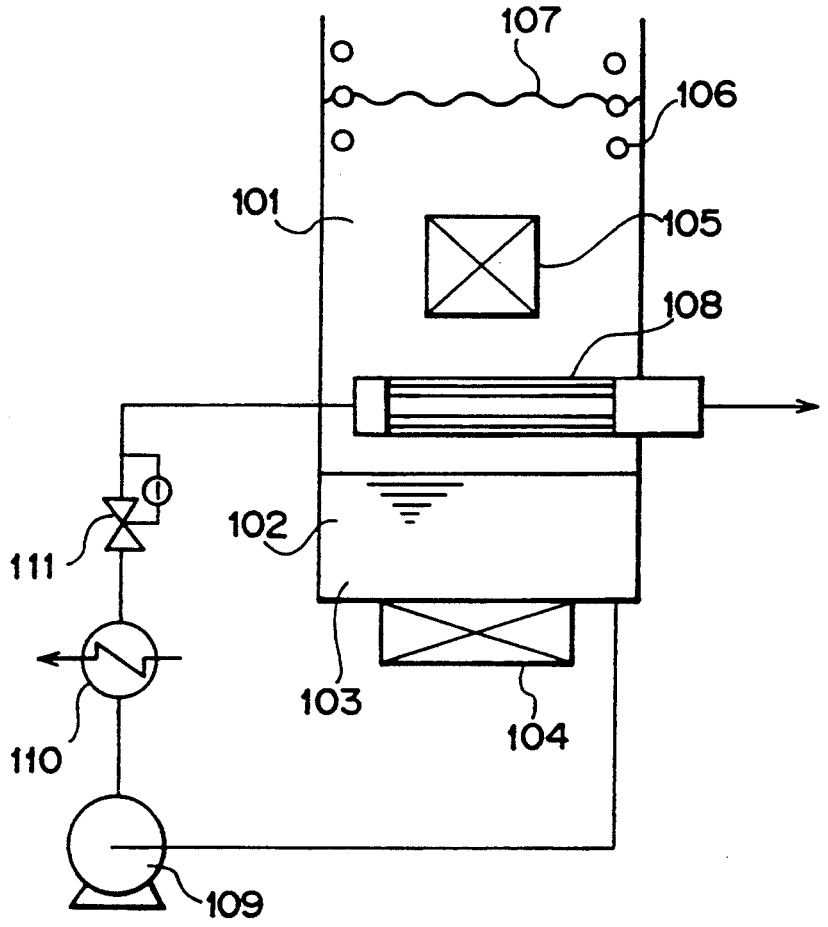
FIG. 5 is a vertical cross-sectional view of a fourth embodiment illustrating a state in which a circulating passage is provided in FIG. 2.

In the most preferable mode of the present invention, part of IPA is drawn out and is supplied to the cavity portion 203 (FIG. 3) at the central portion of the hollow-yarn bundle by means of a pump 109, as shown in FIG. 4 and FIG. 5. The amount of liquid supplied to the cavity portion 203 is preferably greater than or equal to the amount of the drying liquid vapor generated by the vapor generating section per hour. The velocity of IPA flowing radially at the outer peripheral surface of the hollow-yarn bundle, i.e., a linear velocity of the fluid in the radial direction of the hollow-yarn bundle at the outer peripheral surface of the hollow-yarn bundle, is preferably set to not less than 0.025 cm/sec, more preferably not less than 0.1 cm/sec. As the radial flow velocity of the hollow-yarn bundle is set to not less than one of the aforementioned values, the efficiency of the membrane module improves remarkably.

It should be noted that the linear velocity of the fluid in the radial direction of the hollow-yarn bundle at the outer peripheral surface of the hollow-yarn bundle is a value in which (outside diameter of the hollow-yarn bundle−outside diameter of a hollow-yarn membrane×number of hollow yarns at the outermost periphery of the hollow-yarn bundle)×length of the hollow-yarn bundle=area of the opening on the outer peripheral surface, and the amount of liquid supplied to the hollow-yarn membrane module is divided by this area of the opening on the outer peripheral surface.

Next, a description will be given of the basic material of the hollow-yarn membranes 201.

As preferable examples of the basic material of the hollow-yarn membranes 201, it is possible to cite polysulfone, polyether sulfone, polyimide, polyphenylene acetylene, or the like. Yet, it suffices if porous supporting membranes are used which are formed of a basic material whose thermal deformation temperature is 40° C. or more higher than the vapor processing temperature. However, it is most preferable to use basic materials exhibiting a thermal deformation temperature of 150° C. or more in JIS K7207.

It should be noted that the present invention is not limited to a type in which the vapor drying section is disposed above the vapor generating section. For instance, if condensate drops of the solvent on the surface of the object to be dried are introduced to the vapor generating section, the present invention is also applicable to a type in which the vapor generating section is separated from the vapor drying section.

In addition, the configuration of the hollow-yarn membrane module is not limited to a rectilinear configuration, and an S-shaped configuration or the like may be used.

Referring now to FIG. 1, a description will be given of the operation of the vapor drier in accordance with the present invention.

A portion of the vapor drying section 101 below a vapor surface 107 is filled with the IPA vapor evaporated by heating the IPA by the heater block 104. If the object to be dried 105 is held in the vapor drying section, the IPA vapor is condensed on the surface of the object to be dried 105. The IPA which is very hydrophilic flows down together with the water adhering to the surface of the object to be dried 105. As this condensation and flowing down are repeated, the object to be dried is dried.

The water contained in the IPA which has flowed down is removed by the membrane-type separator. At this time, as a flow is created in the IPA in the vicinity of the membrane-type separator by means of a pump or an agitator so as to renew the liquid on the surface of the separating membranes, the dehydrating performance of the membrane-type separator is improved.

In addition, in this invention, since the membrane type separator is disposed in the IPA liquid or vapor, the concentration of water in the IPA quickly reaches a low level.

A detailed description will now be given of the present invention with reference to experimental examples. However, the present invention is not restricted by these experimental examples, and various other modifications are possible within the scope of the gist of the invention.

EXPERIMENTAL EXAMPLE 1

The vapor drier such as the one shown in FIG. 1 was employed. A one-end sealed module using polyimide as the basic material for the hollow-yarn membranes and having one end secured by an epoxy resin adhesive was used as the hollow-yarn membrane module.

Figure 6:
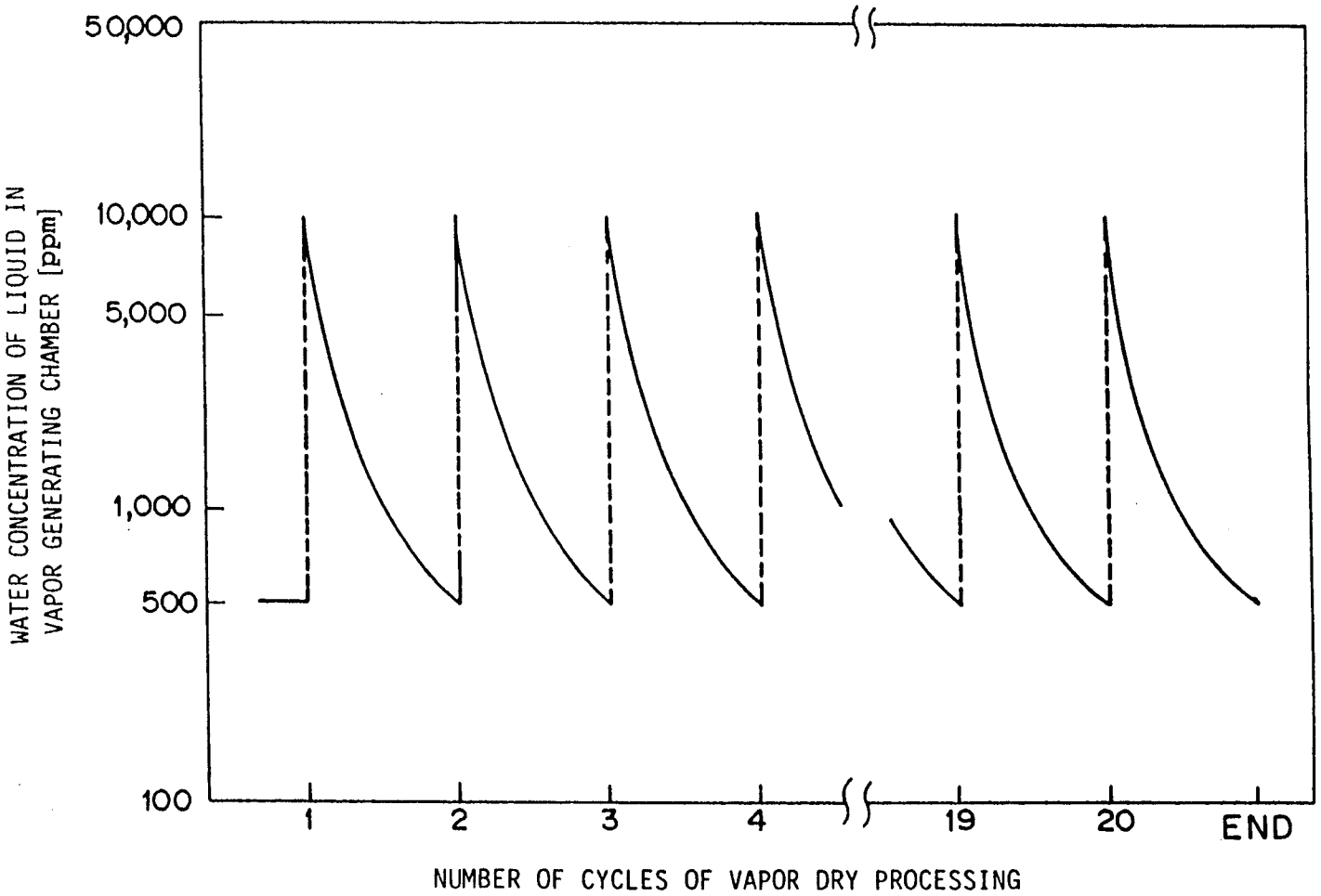
FIG. 6 is a diagram illustrating the change in the amount of water contained in IPA according to the embodiment.

After silicon wafers were immersed in an ultrapure water tank, the silicon wafers were fed to the IPA vapor drier at five-minute intervals, and vapor dry processing of 20 batches was carried out. At this time, the water adhering to a set of silicon wafers and a holding jig was 20 g/set. That is, the rate of water carried in by the silicon wafers was 240 g/hr. Here, the amount of IPA liquid remaining in the vapor generating section of the IPA vapor drier was 60l=48 kg. The remaining IPA liquid was held at a boiling point of 82° C., the primary sides of the heat-resistant hollow-yarn separating membranes made of resin were immersed in the liquid, and the silicon wafers were subjected to vapor drying while the secondary side of the separating membranes was being adjusted to 10 Torr in terms of the degree of vacuum. FIG. 6 shows the results of measurement of the concentration of water in IPA in the vapor generating section at that time. Here, IPA having a water content of 500 ppm was accommodated in the vapor generating section prior to the start of processing. It should be noted that with respect to the IPA whose amount is slightly reduced due to pervaporation, the same IPA as the one described above was automatically replenished so that the liquid level in the vapor generating section became fixed.

EXPERIMENTAL EXAMPLE 2

A circulating pump such as the one shown in FIG. 4 was installed outside the vapor drier used in Experimental Example 1. After the linear velocity of the liquid at the surface of the hollow-yarn separating membrane module was set to 20 cm/sec for circulation, similar processing was carried out.

As a result, the time required until the concentration of water in the solvent dropped to 500 ppm or less was 3 minutes in contrast to 5 minutes in the case of Experimental Example 1. That is, the dehydrating performance of the membranes can be considered to have improved.

In the vapor drier in accordance with the present invention, as the IPA whose water concentration has become high is regenerated and reused, and the water concentration in the IPA is controlled by the provision of the membrane-type separator, it is possible to realize stable and reliable processing conditions speedily, economically and easily. Moreover, since all the processing liquid can be repeatedly used without being discarded, the disposal of the waste liquid becomes unnecessary, thereby making it possible to attain a substantial reduction in cost.

In addition, in the apparatus of this embodiment, there is practically no increase in space entailed by the dehydrating processing of IPA, so that a large advantage is obtained in reducing the space required. In terms of the energy cost, in the apparatus of the present invention, since the membrane-type separator is disposed in the IPA liquid or vapor, it is sufficient if the quantity of heat supplied from the heater provides the heat of vaporization of the water in addition to the quantity of heat required for vapor drying. For this reason, the apparatus of the present invention is advantageous in terms of energy cost as compared with a method in which a dehydrating step is provided separately.

What is claimed is:

1. A vapor drier for drying an object to be dried after washing, comprising:

a vapor generation section or generating vapor of a drying liquid by heating the drying liquid;

a vapor drying section for drying the object to be dried by means of the vapor geared; and a membrane-type separator being disposed in said generating section and constituted by a separating membrane which selectively allows water to permeate said separating membrane, wherein said membrane-type separator is a hollow-yarn membrane module in which 50–50,000 hollow-yarn separating membranes are bundled together, and both ends of said hollow-yarn membrane module being bonded and secured by poting material switch one end of said hollow-yarn membrane module sealed and other other end thereof open, said hollow-yarn membrane module having a cavity in a radially central portion thereof, and said cavity penetrating the potting material at a sealed end of a hollow-yarn bundle and being sealed at an open end of said hollow-yarn bundle.

2. A vapor crier according to claim 1, wherein aid membrane-type separator is located in the drying liquid in said vapor generating section.

3. A vapor drier according to claim 1, wherein said membrane-type separator is located in a space filled with vapor above a drying liquid level in said vapor generating section.

4. A vapor drier according to claim 1, further comprising a passage for drawing out part of the drying liquid and supplying new drying liquid to said cavity in the central portion of said hollow-yarn bundle of said hollow-yarn membrane module.

5. A method of operating said vapor drier according to claim 4, wherein an amount of circulating drying liquid supplied to said cavity in the central portion of said hollow-yarn bundle is greater than or equal to an amount of the drying liquid in said vapor generating section per hour.

6. A method of operating said vapor drier according to claim 5, wherein a fluid velocity in a radial direction of said hollow-yarn bundle is set to 0.025 cm/sec or more.

7. A method of operating said vapor drier according to claim 6, wherein the fluid velocity in the radial direction of said hollow yarn bundle is 0.1 cm/sec or more.

8. A method of operating said vapor drier according to claim 1, wherein a water concentration in the drying liquid is controlled to 1% or less.

9. A method of operating said vapor drier according to claim 8, wherein the water concentration in the drying liquid is controlled to not less than 1 ppm and not more than 500 ppm.

10. A vapor drier for drying an object to be dried after washing, comprising:

a vapor generating section for generating vapor by heating a hydrophilic organic solvent;

a vapor drying section for supplying the vapor generated by said vapor generating section to the object to be dried and causing the vapor to condense; and membrane separating means disposed in the organic solvent in said vapor generating section and adapted to separate water from the organic solvent via a multiplicity of hollow separating membranes; and flow-rate increasing means for causing part of the solvent in said vapor generating section to circulate and supplying the same to a surface of each of said hollow separating membranes of said membrane separating means.

11. A vapor drier for drying an object to be dried after washing, comprising:

a vapor generating section for generating vapor by heating a hydrophilic organic solvent;

a vapor drying section for supplying the vapor generated by said vapor generating section to the object to be dried and causing the vapor to condense; and membrane separating means disposed in vapor in said vapor generating section and adapted to separate water from the organic solvent via a multiplicity of hollow separating membranes; and flow-rate increasing means for causing part of the solvent in said vapor generating section to circulate and supplying the same to a surface of each of said hollow separating membranes of said membrane separating means.

12. A vapor drier for drying an object to be dried after washing, comprising:

a vapor generation section for generating vapor of a drying liquid by heating the during liquid;

a vapor drying section for drying the object to be dried by means of the vapor generated; and a membrane-type separator being disposed in said generating section and constituted by a multiplicity of hollow-yarn separating membranes which selectively allows water to permeate therethrough, said separating membranes being bundled together, and both ends of said hollow-yarn membrane module being bonded and secured by potting materials with one end of said hollow-yarn membrane module sealed and the other end thereof open, said hollow-yarn membrane module having a cavity in a radially central potion thereof, and said cavity penetrating the potting material at a sealed end of a hollow-yarn bundle and being sealed at an open end of said hollow-yearn bundle.

13. A vapor drier according to claim 12, wherein aid membrane-type separator is located in the drying liquid in said vapor generating section.

14. A vapor drier according to claim 12, wherein said membrane-type separator is located in a space filled with vapor above the drying liquid le el in said vapor generating section.

15. A vapor drier according to claim 12, further comprising passage for drawing out part of the drying liquid and supplying new drying liquid to said cavity in thy central portion of said hollow-yarn bundle of aid hollow-yarn membrane module.

16. A method of operating said vapor drier according to claim 15, wherein an amount of circulating drying liquid supplied to said cavity in the central portion of said hollow-yarn bundle is grater than or equal to an amount of the drying liquid in said vapor generating section per hour.

17. A method of operating said vapor drier according to claim 16, wherein fluid velocity in a radial direction of said hollow-yarn bundle is set to 0.025 cm/sec or more.

18. A method of operating said vapor drier according to claim 17, wherein fluid velocity in the radial direction of said hollow-yarn bundle is 0.1 cm/sec or more.

19. A method of operating said vapor drier according to claim 12, wherein the water concentration in the drying liquid is controlled to 1% or less.

20. A method of operating said vapor drier according to claim 8, wherein the water concentration in the drying liquid is controlled to not less than 1 ppm and not more than 500 ppm.

* * * * *

UNITED STATES PATENT AND TRADEMARK OFFICE

CERTIFICATE OF CORRECTION

PATENT NO. : 5,243,768

DATED : September 14, 1993

INVENTOR(S) : Takahisa Fukao et al.

It is certified that error appears in the above-indentified patent and that said Letters Patent is hereby corrected as shown below:

On the title page, Item [30],

The Foreign Application Priority Data, should read:

--Feb. 18, 1991 [JP] Japan.....3-23524

Feb. 18, 1991 [JP] Japan.....3-23525--

Signed and Sealed this

Third Day of May, 1994

Bruce Lehman

*Attest:*

BRUCE LEHMAN

*Attesting Officer*

*Commissioner of Patents and Trademarks*